US008020954B2

(12) United States Patent
Ishizaka

(10) Patent No.: US 8,020,954 B2
(45) Date of Patent: Sep. 20, 2011

(54) RECORDING APPARATUS AND DATA PROCESSING METHOD FOR RECORDING APPARATUS

(75) Inventor: Nobuhiro Ishizaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 11/368,697

(22) Filed: Mar. 7, 2006

(65) Prior Publication Data

US 2006/0203073 A1 Sep. 14, 2006

(30) Foreign Application Priority Data

Mar. 8, 2005 (JP) ..... 2005-064559

(51) Int. Cl.
*B41J 29/38* (2006.01)

(52) U.S. Cl. ..... 347/9; 347/12; 347/14

(58) Field of Classification Search ..... 347/9, 12, 347/14

See application file for complete search history.

(56) References Cited

U.S. PATENT DOCUMENTS

| | | | | |
|---|---|---|---|---|
| 6,648,439 | B2 | 11/2003 | Oikawa | |
| 6,896,345 | B2 | 5/2005 | Nakayama et al. | |
| 6,913,337 | B2 | 7/2005 | Kuronuma et al. | |
| 6,918,646 | B2 | 7/2005 | Kanda et al. | |
| 2003/0193536 | A1 | 10/2003 | Kuronuma et al. | |
| 2003/0193675 | A1 | 10/2003 | Moriyama et al. | |
| 2003/0193691 | A1 | 10/2003 | Tanaka et al. | |
| 2004/0046813 | A1 | 3/2004 | Edamura et al. | 347/14 |
| 2005/0129443 | A1 | 6/2005 | Ishizaka et al. | |
| 2007/0139665 | A1 | 6/2007 | Ishizaka et al. | 358/1.4 |

FOREIGN PATENT DOCUMENTS

| | | | |
|---|---|---|---|
| EP | 1 078 771 | A2 | 2/2001 |
| EP | 1355265 | A2 | 10/2003 |
| EP | 1355266 | A2 | 10/2003 |
| GB | 2135800 | A | 9/1984 |
| JP | 11-020204 | | 1/1999 |
| JP | 2001-191587 | | 7/2001 |
| JP | 2003-305895 | | 10/2003 |
| JP | 2003-305896 | | 10/2003 |
| JP | 2003-305903 | A | 10/2003 |
| JP | 2004-017371 | A | 1/2004 |
| KR | 2002-0090323 | | 12/2002 |
| KR | 2003-0082403 | | 10/2003 |
| KR | 2003-0082404 | | 10/2003 |

*Primary Examiner* — Julian D Huffman

(74) *Attorney, Agent, or Firm* — Fitzpatrick, Cella, Harper & Scinto

(57) ABSTRACT

A host device sends, as setting data, data including a registration adjustment value corresponding to a relative distance between nozzle arrays in a scanning direction. A recording apparatus includes a recording buffer 4 that stores recording data of each nozzle array in association with a recording position in a scanning direction. A record buffering structure control circuit 8 controls to adjust storage positions of recording data of each nozzle array and store the recording data in the recording buffer 4, based on a registration adjustment value stored in a register and information regarding the readout order of the recording data.

5 Claims, 11 Drawing Sheets

201
COM-MAND
202
DATA LENGTH
203
SETTING DATA
204
COM-MAND
205
DATA LENGTH
206
SETTING DATA
207
COM-MAND
208
DATA LENGTH
FIRST BLOCK DATA
IMAGE DATA
209
210
COM-MAND
211
DATA LENGTH
SECOND BLOCK DATA
IMAGE DATA
212
.....

213
FIRST COLOR DATA
214
SECOND COLOR DATA
215
EIGHTH COLOR DATA
DATA
COMPRESSION TAG
COLOR CHANGE CODE
216
217
218
.....

FIG. 4

| 1ST BLOCK | 2ND BLOCK | 3RD BLOCK | 4TH BLOCK | 5TH BLOCK | 6TH BLOCK | 7TH BLOCK | 8TH BLOCK |
|---|---|---|---|---|---|---|---|
| 1ST COLOR DATA | 1ST COLOR DATA | 1ST COLOR DATA | 1ST COLOR DATA | 1ST COLOR DATA | 1ST COLOR DATA | 1ST COLOR DATA | 1ST COLOR DATA |
| 2ND COLOR DATA | 2ND COLOR DATA | 2ND COLOR DATA | 2ND COLOR DATA | 2ND COLOR DATA | 2ND COLOR DATA | 2ND COLOR DATA | 2ND COLOR DATA |
| 3RD COLOR DATA | 3RD COLOR DATA | 3RD COLOR DATA | 3RD COLOR DATA | 3RD COLOR DATA | 3RD COLOR DATA | 3RD COLOR DATA | 3RD COLOR DATA |
| 4TH COLOR DATA | 4TH COLOR DATA | 4TH COLOR DATA | 4TH COLOR DATA | 4TH COLOR DATA | 4TH COLOR DATA | 4TH COLOR DATA | 4TH COLOR DATA |
| 5TH COLOR DATA | 5TH COLOR DATA | 5TH COLOR DATA | 5TH COLOR DATA | 5TH COLOR DATA | 5TH COLOR DATA | 5TH COLOR DATA | 5TH COLOR DATA |
| 6TH COLOR DATA | 6TH COLOR DATA | 6TH COLOR DATA | 6TH COLOR DATA | 6TH COLOR DATA | 6TH COLOR DATA | 6TH COLOR DATA | 6TH COLOR DATA |
| 7TH COLOR DATA | 7TH COLOR DATA | 7TH COLOR DATA | 7TH COLOR DATA | 7TH COLOR DATA | 7TH COLOR DATA | 7TH COLOR DATA | 7TH COLOR DATA |
| 8TH COLOR DATA | 8TH COLOR DATA | 8TH COLOR DATA | 8TH COLOR DATA | 8TH COLOR DATA | 8TH COLOR DATA | 8TH COLOR DATA | 8TH COLOR DATA |

RECORDING APPARATUS AND DATA PROCESSING METHOD FOR RECORDING APPARATUS

FIELD OF THE INVENTION

The present invention relates to a recording apparatus and a data processing method for a recording apparatus and, more particularly, to a process of recording data in a recording apparatus which records by scanning a recording head having a plurality of recording element arrays in which a plurality of recording elements are aligned in a predetermined direction, in a direction intersecting with the alignment direction of the recording elements.

BACKGROUND OF THE INVENTION

A printer that records information such as characters or images on a sheet-like recording medium such as a paper sheet or film is widely used as an information output apparatus for word processors, personal computers, facsimile machines, and the like.

Various methods are known as recording methods for printers. An inkjet printing method can realize non-contact printing on a recording medium such as paper. This method has been attracting attention recently because it easily prints in color, and is quiet. As the configuration for an inkjet printing method, a serial recording system is well known that performs recording while reciprocally scanning a carriage mounted with a recording head that discharges ink in response to recording information in a direction intersecting the transport direction of a recording medium such as a paper sheet. In general, the serial recording system is widely used for reasons including low cost and easy downsizing.

In the serial recording system, recording is carried out by scanning a carriage mounted with a recording head over a recording medium. Therefore, in a recording apparatus (printing apparatus) according to the serial recording system, a recording area in the scanning direction of the recording head is divided into a plurality of areas, and the apparatus has a buffer that stores recording data in units for the divided areas.

In this type of recording apparatus, when storing recording data in units for divided areas in a buffer, the apparatus compares information that changes the storage area of recording data for each color with the remaining amount of buffer available for storage and a write address update amount. The recording apparatus includes a writing control section that controls write address information of recording data of unit areas for each color based on the comparison result (Japanese Patent Laid-Open No. 2003-305896).

The recording apparatus further comprises a reading control section that controls, for each color, reading address information for reading recording data that was stored in the buffer, and record data generating means that generates recording data of the divided area units in accordance with the recording data that was read based on the reading address information.

In the conventional recording apparatus configured in this manner, although a read address in a recording buffer is referred to at the time of write control to the recording buffer, the read address is not updated each time data is read out, and instead addresses are updated after all the data of one block is read out (Japanese Patent Laid-Open No. 2003-305895).

SUMMARY OF THE INVENTION

Generally, in order to speed up a recording data generation process at a host computer, image conversion or registration adjustment is performed at the recording apparatus side. Furthermore, to reduce costs, the capacities of recording buffers are being made smaller to reduce the capacities of RAMs and the like.

In this kind of recording apparatus, when writing recording data in a recording buffer, the waiting time (write wait time) until all the data of one block is read out is relatively long.

Recently, recording resolutions of recording apparatuses have increased and the amount of recording data transferred to recording apparatuses from host computers has also increased. As the amount of recording data increases, more time is required to generate the recording data at the host computer and to transfer the data thereafter. Accordingly, there is a decrease in the effective speed from the time recording is designated until the recording is actually executed at the recording apparatus.

For the above reasons, in order to effectively correct an installation error that occurs when attaching a recording head and also reduce the time until recording is executed after issuing a record instruction, it is necessary to reduce the time required by a host computer (printer driver) to generate recording data and transfer the data to a recording apparatus.

This invention was made in view of the above circumstances, and it is an object of this invention to effectively perform writing of recording data in a recording apparatus and to shorten the time until recording is actually executed upon designation of recording, even when the capacity of a recording buffer is small.

According to one aspect of the present invention, the above object is attained by a recording apparatus which records by scanning a recording head having a plurality of recording element arrays in which a plurality of recording elements are aligned in a predetermined direction, in a direction intersecting with the alignment direction, and comprises:

a receiving buffer which stores setting data and recording data of the recording element arrays that are transmitted from a connected host device, the setting data containing registration information corresponding to a relative distance between the recording element arrays in a scanning direction;

a recording buffer which stores the recording data of the recording element arrays in association with recording positions in the scanning direction; and writing control means for controlling to adjust storage positions of the recording data of the recording element arrays and store the recording data in the recording buffer on the basis of the registration information and information regarding read positions of recording data, reading from the recording buffer, of the recording element arrays.

Thus, a registration adjustment process associated with the relative distance between the recording element arrays that has conventionally been done in a host device is executed on the recording apparatus side and, at the same time, it is possible to effectively store (write) recording data in the recording buffer based on information regarding read positions from the recording data, reading from the recording buffer, of the recording element arrays.

Accordingly, even when the capacity of the recording buffer is small, writing of recording data in a recording apparatus can be effectively performed and the time until recording is actually executed upon designation of recording can be shortened.

When the recording buffer is configured to divide a recording area in the scanning direction into a plurality of blocks, and store the recording data in each block, preferably the writing control means modifies storage starting positions in the blocks of recording data of the recording element arrays in accordance with registration information, and includes determining means which determines whether or not it is possible to store recording data that was sent from a host device in correspondence with the relevant block based on read position information.

The read position information preferably includes, for each recording element array, a read address, information indicating the existence or non-existence of read data, and information indicating the existence or non-existence of recording data.

When the capacity of the recording buffer is less than the amount of data that the recording head can record with one scanning, preferably the writing control means uses the recording buffer cyclically by storing the recording data in the top address of the recording buffer following the bottom address.

Preferably, the writing control means updates the read position information each time recording data is read out from the recording buffer.

The recording apparatus may be configured to perform recording with the recording element arrays in respectively different colors (black, cyan, magenta, yellow, etc.).

Preferably, each recording element is configured to perform recording by discharging ink. More preferably, each recording element comprises a thermal energy converter for generating thermal energy to be applied to ink in order to discharge ink by using thermal energy.

According to another aspect of the present invention, the above object is attained by a data processing method for a recording apparatus which records by scanning a recording head having a plurality of recording element arrays in which a plurality of recording elements are aligned in a predetermined direction, in a direction intersecting with the alignment direction, and comprises a receiving buffer that stores setting data and recording data of the recording element arrays transmitted from a connected host device, and a recording buffer that stores the recording data of the recording element arrays in association with recording positions in the scanning direction; comprising a step of controlling to adjust storage positions of the recording data of the recording element arrays and store the recording data in the recording buffer on the basis of registration information that corresponds to a relative distance between the recording element arrays in a scanning direction which is contained in the setting data and information regarding read positions of recording data, reading from the recording buffer, of the recording element arrays.

In addition, the above object is also achieved by a computer program which causes a computer apparatus to implement the data processing method for the recording apparatus, and a storage medium which stores the computer program.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 4 is a view showing the data structure of a recording buffer that holds recording data;

DETAILED DESCRIPTION OF THE PREFERRED EMBODIMENTS

Hereunder, preferred embodiments of this invention are described in detail by way of examples while referring to the attached drawings. The components described in the following embodiments are strictly for the purpose of exemplification, and the following description is not intended to limit the scope of the present invention solely to the these embodiments.

As used in this specification, the term "record" (may also be referred to as "print") refers not only to a case of forming significant information such as characters and graphics on a recording medium, but also refers broadly to cases of forming an image, design or pattern on a recording medium or to processing a medium, irrespective of whether the information is significant or insignificant or whether or not the information is manifested so that it can be visually perceived by a human.

Further, as used herein the term "recording medium" refers not only to paper that is used in an ordinary recording apparatus, but also refers broadly to material capable of accepting ink, such as cloth, plastic film, a metallic plate, glass, ceramics, wood or leather.

Furthermore, as used herein the term "ink" (may also be referred to as "liquid") should be broadly construed similarly to the definition of the above term "record (print)", and thus refers to a liquid that can be provided, by application onto a recording medium, for formation of an image, design, pattern or the like, to processing of a recording medium, or to processing of ink (for example, solidification or insolubilization of a coloring material in ink to be applied to a recording medium).

Further, unless specifically described otherwise, as used herein the term "nozzle" (may also be referred to as "recording element") refers to a discharging aperture or in general to a liquid channel communicating thereto and an element that generates energy to be utilized for discharging ink.

Hereunder, a specific description is given of an embodiment that applies the inkjet recording apparatus (printing apparatus) of this invention.

<Outline Configuration of the Recording Apparatus>

Figure 1:
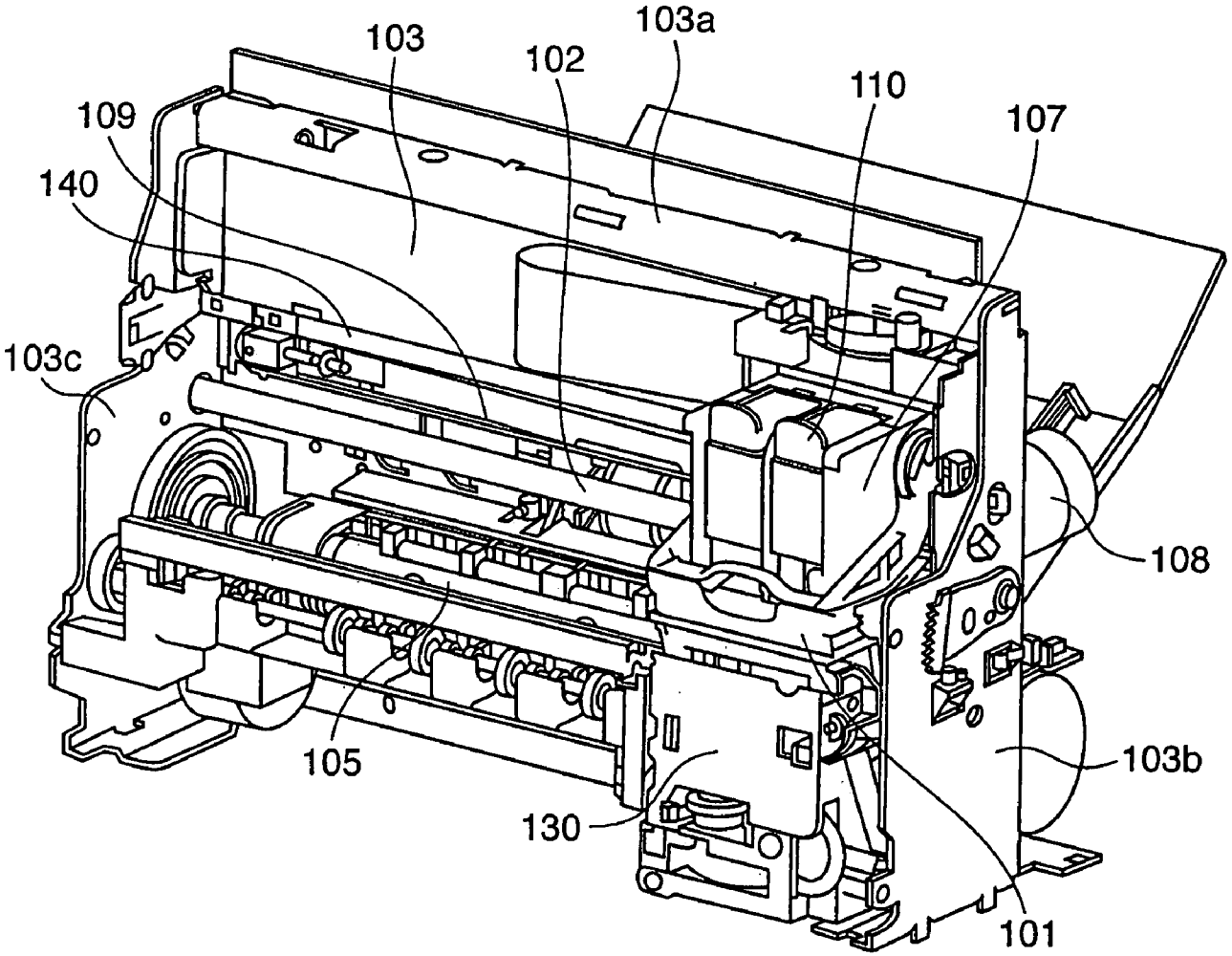
FIG. 1 is a perspective view showing an outer appearance of an inkjet recording apparatus as a preferred embodiment of this invention, in a state in which the cover has been removed.

FIG. 1 is a perspective view showing an outline configuration of an inkjet recording apparatus of this embodiment in a state in which the cover has been removed.

In FIG. 1, a recording cartridge 110 having a recording head and an ink tank provided in an integrated condition is mounted on a carriage 101, and the carriage 101 can travel along a guide shaft 102. In this embodiment, a recording head is a recording head of an inkjet printing system. Reference numeral 103 denotes a chassis that consists of a main chassis 103*a* and left and right side plates 103*b* and 103*c*. Reference numeral 108 denotes a carriage motor as the driving source of the carriage. Reference numeral 109 denotes a belt that is connected to the carriage and driven by the carriage motor 108. Reference numeral 130 denotes a recovery unit that performs cleaning and suction operations on a recording head discharging surface. Reference numeral 140 denotes a scale consisting of a CR encoder that calculates the position and speed of the carriage 101 and a light emitting element and a light receiving element that are mounted on the carriage.

A recording sheet serving as a recording medium is fed into the apparatus main body by a sheet feed roller (not shown). The recording sheet is then pinched by a sheet supply roller 105, a pinch roller (not shown) and a sheet press plate (not shown), and conveyed to the recording area of the recording cartridge 110 to perform recording.

The recording cartridge 110 includes two kinds of cartridges: a color recording cartridge that holds ink of three colors, i.e. yellow, magenta and cyan, and a black recording cartridge that holds black ink. The two recording cartridges are separately inserted into a cartridge guide 7.

The inkjet recording apparatus of this embodiment is connected to a host computer, and records upon reception of recording data from the host computer (printer driver). The recording apparatus of this embodiment records by scanning the carriage supporting the recording cartridge 110 including a recording head on a recording medium. For this purpose, this recording apparatus divides a recording area of the recording head in the scanning direction into a plurality of areas, and records (prints) an image in each divided area.

Figure 2:
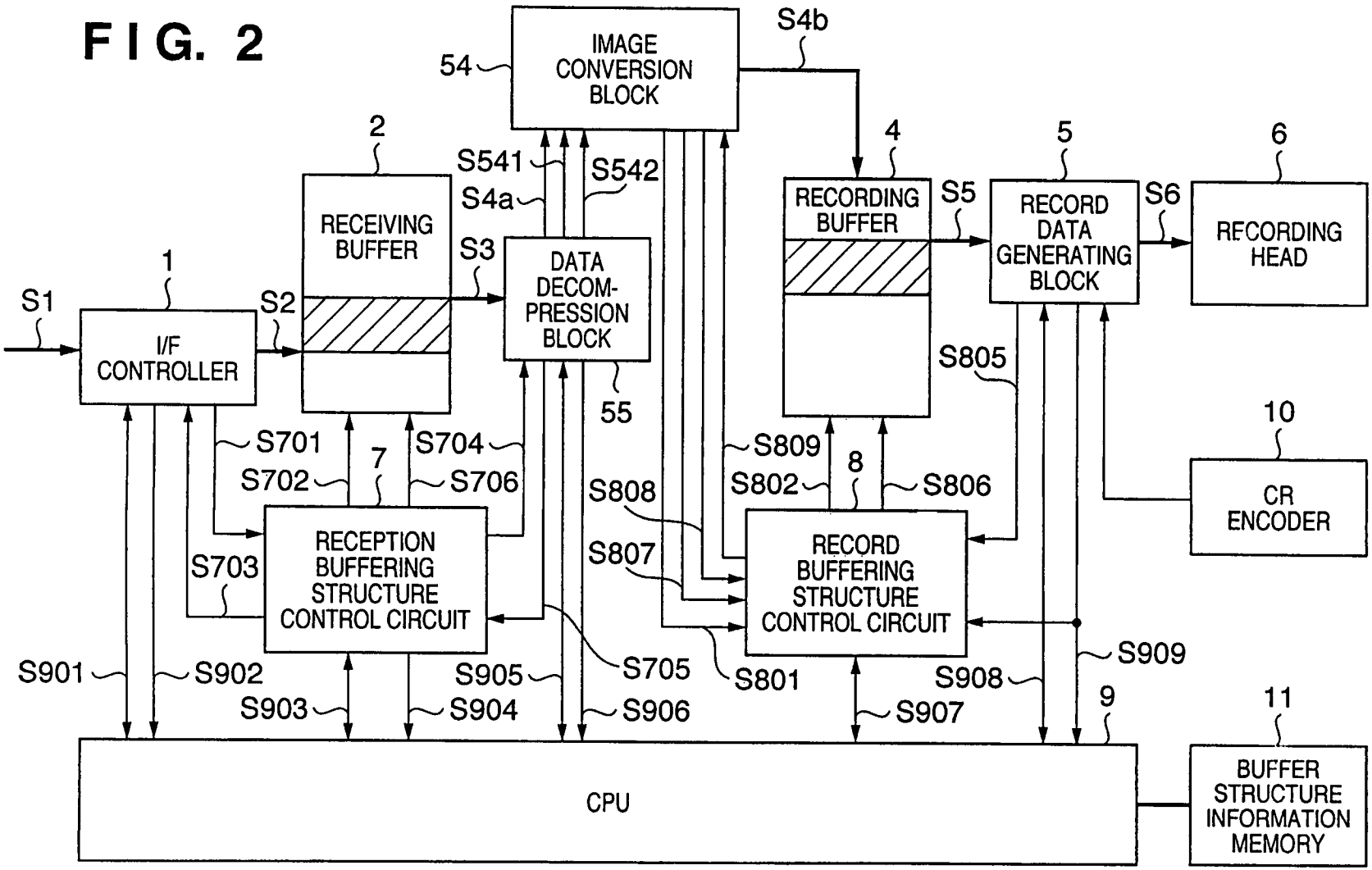
FIG. 2 is a block diagram showing the configuration of a record controlling section of the inkjet recording apparatus of FIG. 1.

In this case, according to the inkjet recording apparatus of this embodiment, the host computer does not perform positional adjustment (registration adjustment) of recording data in the scanning direction by a data process for each bit. Instead, registration adjustment of recording data is performed by a record buffering structure control circuit 8 in the recording apparatus, as shown in FIG. 2 to be described later. This makes it possible to speed up generation of recording data by the host computer and increase an effective recording speed.

<Configuration of Record Controlling Section>

FIG. 2 is a block diagram showing the configuration of a record controlling section of the recording apparatus of this invention. In the figure, reference numeral 1 denotes an interface controller that receives data transferred thereto from a host computer (not shown) through an interface signal line S1. The interface controller 1 extracts recording data and data required for operation of the recording apparatus from the received data to temporarily accumulate the data. Data that was extracted by the interface controller 1 is stored in a receiving buffer 2 via a signal line S2.

Figures 3A, 3B:
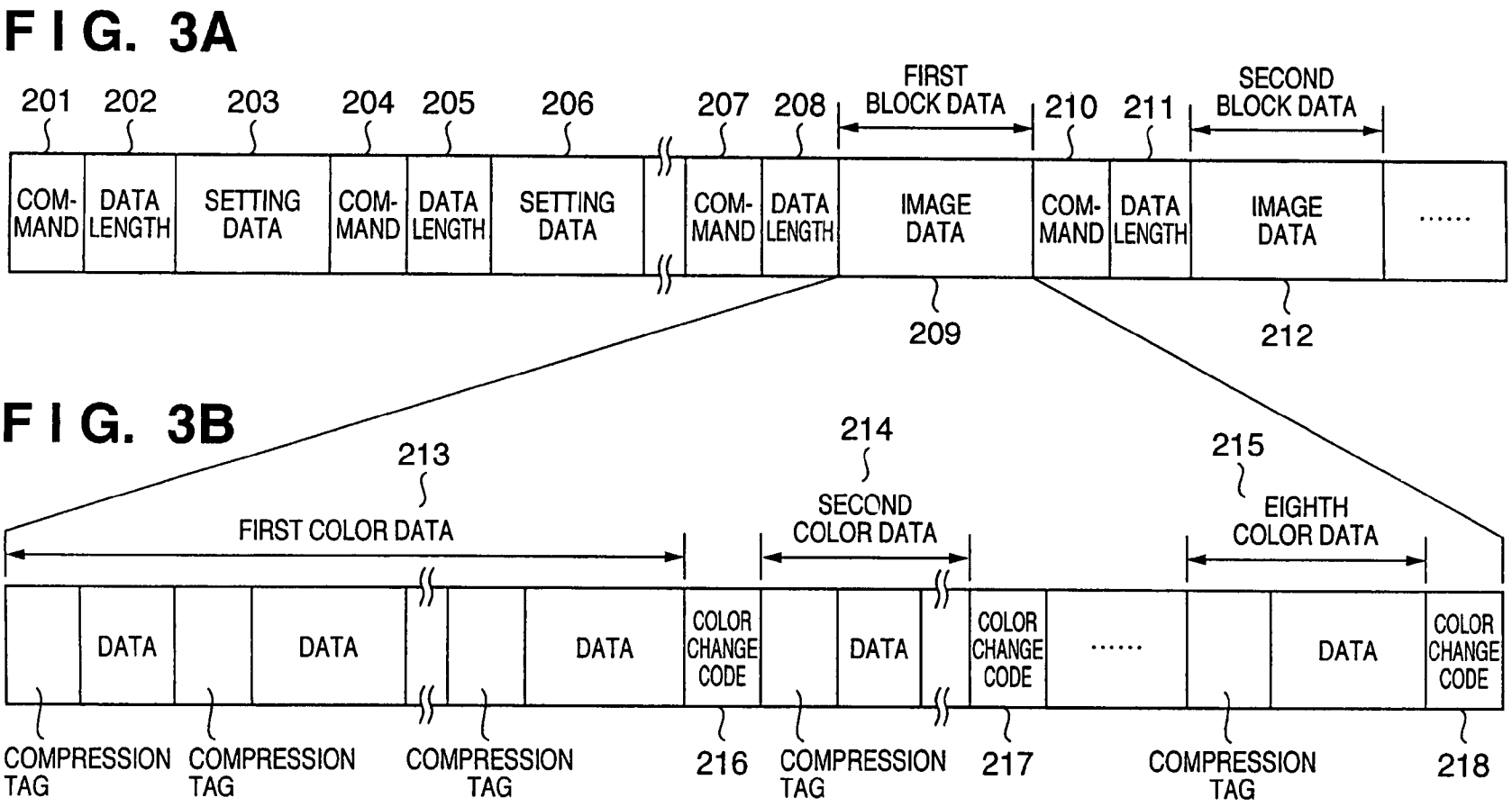
FIGS. 3A and 3B are views showing the structure of data that is transferred from a host computer and stored in a receiving buffer.

The receiving buffer 2 consists of a memory such as a SRAM or a DRAM, and data stored in the receiving buffer has a structure as shown in FIG. 3A or 31.

As represented by the data structure of the receiving buffer in FIG. 3A, "command" (201), "data length" (202), and "setting data" (203) are sequentially stored from the left. Subsequently, "command" (204), "data length" (205), and "setting data" (206) are stored. This indicates that data transferred in time series are stored at consecutive addresses in the receiving buffer. The setting data 206 is information representing execution of paper feed, setting of the paper supply amount, the number of recording heads for use, and the like. The recording apparatus can start to record only after all the pieces of information defined by the setting data are obtained. Subsequent to these data, recording data such as image data (209 and 212) to be recorded are stored in the receiving buffer 2.

The recording data (209 and 212) are data obtained by dividing a data amount necessary to record by scanning the recording head once on a recording medium into block units each having a smaller data amount. The recording data that were divided into block units are separated, and the data are sequentially stored as the first block data (209), second block data (212), and so forth.

FIG. 3B is a view showing in detail the data structure of recording data divided into block units. As shown in FIG. 3B, recording data for a plurality of colors (213 to 214) are sequentially stored as compressed data. Compression TAGs and compressed data are separated by "color change codes" (216, 217, and 218).

For example, assuming recording data exists for four colors, i.e. cyan, yellow, magenta and black, a recording head is used which has, in the scanning direction, two nozzle arrays each having 64 nozzles in the longitudinal direction for each color. Since data of each nozzle array forms recording data of one color, compressed recording data for two nozzle arrays× four colors, that is, for the first color to the eighth color, are stored as recording data in one block data.

The nozzles of each nozzle array are aligned in the transporting direction of the recording medium. For example, data of the first and second colors are recording data corresponding to cyan, data of the third and fourth colors are recording data corresponding to magenta, data of the fifth and sixth colors are recording data corresponding to yellow, and data of the seventh and eighth colors are recording data corresponding to black.

FIG. 4 is a view showing the data structure of the recording buffer that holds recording data. For example, when the recording apparatus records by a length of about eight inches at maximum in the scanning direction by one scanning and one block data corresponds to a size that is enough to record about one inch in the scanning direction, an image of one scanning is completed by recording the recording data of a total of eight blocks. The first to eighth blocks are arranged in the scanning direction of the recording head, and each block data contains Recording data of the first color to data of the eighth color. The length of recording data of each color stored in each block corresponds to the number of nozzles of the recording head.

Referring back to FIG. 2, each control block will be explained. Of data stored in the receiving buffer 2, "command", "data length", and "setting data" serving as setting values for controlling the recording apparatus are read out from an interface controller 1 by a CPU 9 via a signal line S902, and set in control circuits (7 and 8) in the figure (S903 and S907). The CPU 9 interprets the readout data (data corresponding to 201 to 208 in FIG. 3A), and centralizes the overall recording control of the recording apparatus in accordance with the result. For processing of the recording data, the CPU 9 activates a data decompression block 55 and causes it to execute processing.

As shown in FIG. 3B, the data decompression block 55 reads out three data "compression TAG", "compressed data", and "color change code" from the receiving buffer 2, and executes data rasterization control on the basis of these data. This embodiment employs PackBits compression as a data compression/decompression method. Therefore, when the compression TAG takes an 8-bit value of 00h to 7Fh, data are processed on the assumption that one to 128 non-contiguous data exist in the data area. Further, when the compression TAG takes an 8-bit value of FFh to 81h, the next 1-byte data is decompressed into two to 128 contiguous data. If 80h is read out by a data read process, data is processed as a color change code. Decompressed data is sent to an image conversion block 54 via a signal line S4*a*. The data undergoes HV conversion by the image conversion block, and the HV-converted data is stored in a recording buffer 4 via a signal line S4*b*.

The recording buffer 4 stores the decompressed recording data in the data structure shown in FIG. 4. The start data of the recording data for the first color of the first block is written at the top address of the recording buffer 4. Subsequent data are sequentially written by properly changing the address. An area capable of storing data for one color at the address of the recording buffer is determined by setting data first loaded by the CPU 9, and data larger than the value of the setting data cannot be written.

In compressing recording data, the data size is limited in accordance with the setting data. Data after detecting a color change code are sequentially written from the top address of the recording data for the second color. Control of this address data is executed by the record buffering structure control circuit 8 (to be described later).

Write is repeated from the data for the first color to the data for the eighth color in the first block. If a color change code is detected after the end of writing the data for the eighth color, write of all the data of the first block is complete. The data decompression block 55 ends the data rasterization operation, notifies the CPU 9 by an interrupt (S906) of the completion of rasterizing data of one block, and waits for activation of next data rasterization from the CPU 9.

At a stage when the recording data of a plurality of blocks is arranged in the recording buffer 4, the CPU 9 activates a carriage motor (denoted by reference numeral 108 in FIG. 1) to start a recording operation. Thus, by carrying out recording by transferring recording data in synchronization with a carriage encoder (CR encoder) 10 while scanning the carriage with recording head 6 (recording cartridge 110) mounted thereon, an image can be completed on a paper surface (on a recording medium). After the recording head 6 completed scanning in the main scanning direction, transport means transports the recording medium in a sub-scanning direction. Thus, by repeatedly performing scanning of the recording head and transport of the recording medium, the recording of an image for one page is carried out.

A record data generating block 5 reads the block structure of recording data that exists on the recording buffer 4 through a signal line S5 at a timing synchronized with the CR encoder 10, in accordance with a value specified from the CPU 9, and outputs the data to a signal line S6 while converting it into a data structure that the recording head 6 can record. The record data generating block 5 holds information regarding the block widths (showing the length of blocks) within the recording buffer to be described later, and information regarding the height of each color of the blocks ("the number of rasters" of color data or "the number of nozzles" of the recording head).

Data areas read from the recording buffer 4 are cleared to zero in order to store the next recording data.

<Write/Read Control of Receiving Buffer>

As described above, the interface controller 1 writes data in the receiving buffer 2, and the data decompression block 55 reads only recording data from the receiving buffer 2. A reception buffering structure control circuit 7 controls the write addresses and read addresses at that time. The reception buffering structure control circuit 7 controls the top address and bottom address of the receiving buffer 2 as well as write addresses and read addresses.

Each time the reception buffering structure control circuit 7 accepts a write request signal (S701) that is received from the interface controller 1 it adds one address, and outputs this to the receiving buffer 2 as write address information (S702). When the reception buffering structure control circuit 7 reaches the bottom address of the receiving buffer 2, it performs control to return the write address to the top address of the receiving buffer 2.

When the receiving buffer 2 becomes full of data and the write address reaches (matches) a read address, it sends an instruction not to write the next data to the interface controller 1 through a signal line S703.

At this time, it also simultaneously notifies the CPU 9 with an interrupt signal of a signal line S904 that the receiving buffer 2 is in a state in which writing of data is not possible. The structure of the receiving buffer 2 can be set by the CPU 9 writing to an internal register using a bus of the signal line S903.

For read addresses, when the CPU 9 reads data in the receiving buffer 2 directly through a data read register in the reception buffering structure control circuit 7, in a case where the data decompression block 55 made a request through a data read request signal line S705, addresses are added one at a time and output as read addresses to the receiving buffer 2 through a signal line S706.

When the read addresses reach the bottom address, the reception buffering structure control circuit 7 performs control to return the read address to the top address of the receiving buffer 2. Further, when a read address reaches (matches) a write address, since the data was eliminated from the receiving buffer the reception buffering structure control circuit 7 sends an instruction not to read the next data to the data decompression block through a signal line S704. At this time, it also simultaneously notifies the CPU 9 with an interrupt signal line of the signal line S904 that there is no data to be read in the receiving buffer 2.

The foregoing is a description of the processing contents of write and read control of data with respect to the receiving buffer 2. Next, process contents for writing, in the recording buffer, data which is read out from the receiving buffer 2 and rasterized, or reading out data from the printing buffer will be explained.

<Write/Read Control of Recording Buffer>

The image conversion block 54 writes recording data to the recording buffer 4, and the record data generating block 5 reads the recording data that was written. At that time, the record buffering structure control circuit 8 controls the write addresses and read addresses.

The record buffering structure control circuit 8 controls the top address and bottom address of the recording buffer as well as the write addresses and read addresses.

Each time the record buffering structure control circuit 8 accepts a write request signal (S801) that is received from the image conversion block 54 it changes the address appropriately, and outputs this to the recording buffer 4 as write address information (S802). When the record buffering structure control circuit 8 reaches the bottom address of the recording buffer 4, it performs control to return the write address to the top address of the recording buffer 4.

When a write address reaches (matches) a read address indicating that the recording buffer 4 has become full of data, it sends an instruction not to write the next recording data to the image conversion block 54 through a signal line S809.

Further, when the data decompression block 55 reads a color change code from the receiving buffer 2, the data decompression block 55 notifies the image conversion block 54 to that effect through a signal line S541. The image conversion block then outputs to the record buffering structure control circuit through a signal line S807. The record buffering structure control circuit 8 prepares to output a top address for storing data of the next color from the signal line S802. The structure of the recording buffer 4 can be set by the CPU 9 writing to an internal register using the bus of the signal line S907.

When the record data generating block 5 sends a request through a data read request signal line S805 for each color, read addresses are added one at a time and output to the recording buffer 4 through a signal line S806.

When a read address reaches the bottom address, the record buffering structure control circuit 8 performs control to return the read address to the top address of the recording buffer 4.

The record data generating block 5 sets the data structure of the recording data block that is currently being read, in a register inside the record data generating block 5 through the bus of a signal line S908 from the CPU 9. When all of the recording data in the recording data block structure that was set has been read, the record data generating block 5 sends a termination signal S909 to the CPU 9 as an interrupt signal. At this time, if the next recording data block is already expanded on the recording buffer 4, it writes that recording data block structure in the register.

The recording buffer 4 controls writing of data in units of one recording data block, and it does not activate a record data generating block for a recording data block that has not been written. Accordingly, a case will not occur in which the read addresses of the recording buffer exceed the write addresses. Reference numeral 11 denotes a buffer structure information memory. This is a working memory (work RAM) for controlling the recording buffer, and is an area that temporarily stores information regarding a recording buffer to be described later.

<Description of Record Buffering Structure Control Circuit>

Figure 5A:
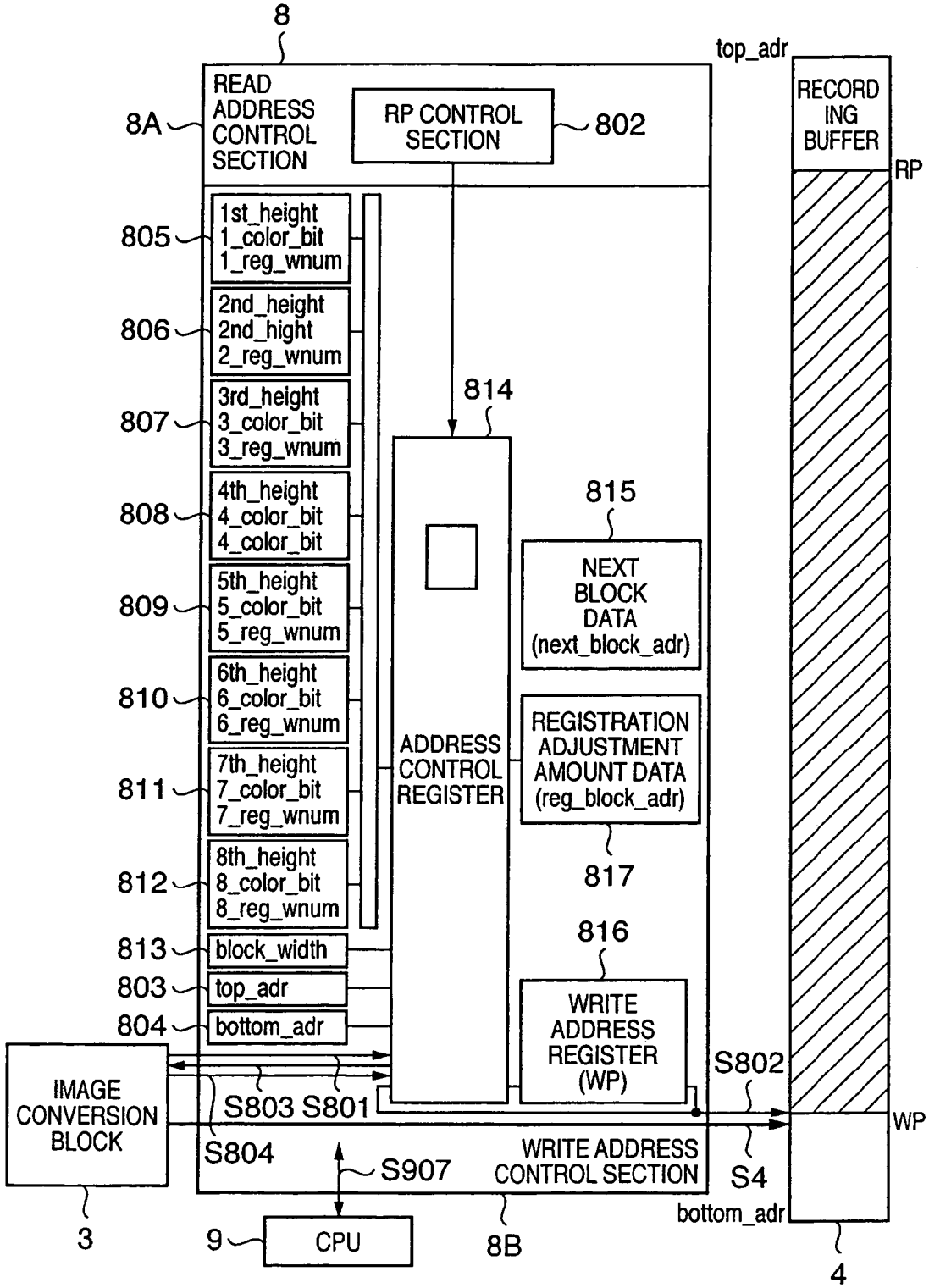
FIG. 5A is a view for explaining write address control of a record buffering structure control circuit.
Figure 8:
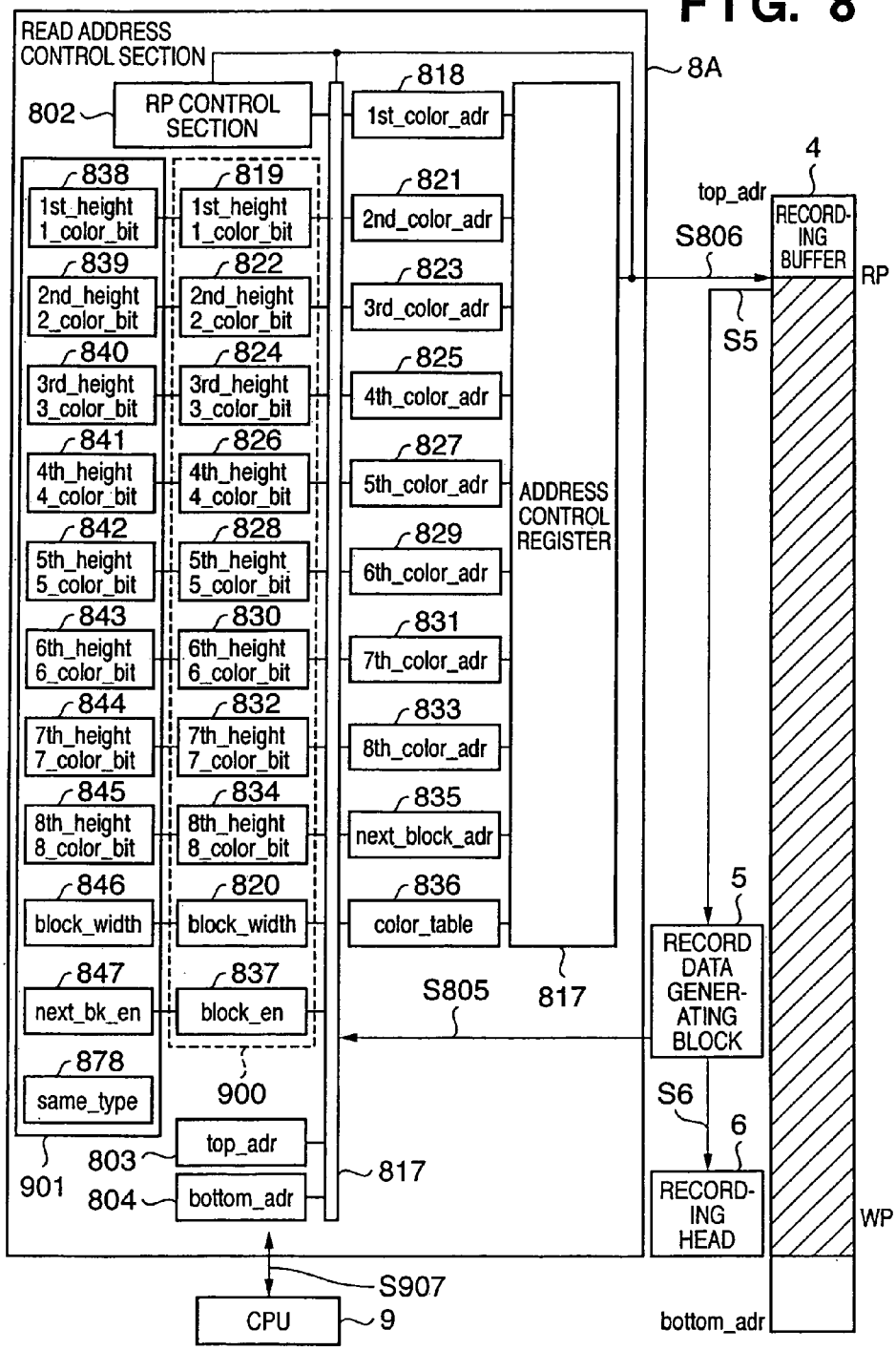
FIG. 8 is a view for explaining a process of reading out data from the recording buffer by the record buffering structure control circuit.

The record buffering structure control circuit will be described with reference to FIGS. 5A and 8. Among the processes performed by the record buffering structure control circuit, FIG. 5A is a view for mainly explaining write address control, and FIG. 8 is a view for mainly explaining read address control by the record buffering structure control circuit 8.

The record buffering structure control circuit 8 comprises a reading control section 8A and a write address control section 8B. In the buffer area of the recording buffer 4, a top address of the recording buffer is indicated by top_adr and a bottom address is indicated by bottom_adr. This top address is stored in a register 803 inside the write address control section 8B, and the bottom address is stored in a register 804 inside the write address control section 8B.

Reference characters "RP" shown at the recording buffer 4 denote a read pointer, and reference characters "WP" denote a write pointer. A hatching portion between reference characters RP and WP in the recording buffer indicates that recording data is stored therein. White portions of the recording buffer 4 indicate that recording data is not stored therein.

Reference numeral 802 within the read address control section 8A denotes a register showing a read address (RP: read pointer) of data. Reference numerals 805 to 812 denote registers that store information for each color of the first to eighth colors. In this example, in the register 805 is stored buffer height information of the first color data (1st_height), information indicating the existence or non-existence of data for the first color (1_color_bit), registration adjustment value information of the first color (1_reg_wnum), information indicating the existence or non-existence of an inclination correction for each nozzle of the first color (1_color_S_bit), and registration adjustment value information of inclination corrections for each nozzle of the first color (1_s_reg_wnum). The same information is set in a similar manner in registers 806 to 812 for the second to eighth colors.

Since the registration adjustment value information (1_reg_wnum) is a value corresponding to the relative position between nozzle arrays in the raster direction, it always takes the same value for one nozzle array. More specifically, each nozzle array has one registration adjustment value information. For example, letting the first nozzle array be a reference, the registration adjustment value information for the recording data for the first color is 0.

If the distance between the second nozzle array and the first nozzle array is A columns, the registration adjustment value information for the recording data for the second color is A. If the distance between the third nozzle array and first nozzle array is B columns, the registration adjustment value information for the recording data for the third color is B. In this manner, registration adjustment value information for recording data for the second to eighth color is set in correspondence with the relative distances to nozzle arrays from the reference defined by the position of the first nozzle array for recording data for the first color.

Reference numeral 813 denotes a register which sets block width information (block_width). This width information is a value that is commonly used for each block from the first to eighth colors.

The above height information, width information and registration adjustment value information of the block are contained in the setting data described in FIG. 3A.

Reference numeral 815 denotes a register that stores the address of the next block data. This address can be decided using a value from any of the registers from register 805 to register 812 that store information relating to each color and the value of the register 813 that stores width information relating to block data. The writing control section 8B decides the write start address of the second block data as the next write object in accordance with setting information relating to the first block data as a write object, and stores the address in this register.

Reference numeral 817 denotes a register that stores a write start address of a registration adjustment amount. This address can be decided using values of all of the registers from register 805 to register 812 that store information relating to each color and the value of the register 813 that stores width information relating to block data. The writing control section 8B decides the write start address of the registration adjustment amount as the next write object in accordance with setting information relating to the first block data as a write object, and stores the address in this register.

In this connection, for example, with respect to data of the first color, before completing the writing of recording data corresponding to data of the first block, the writing control section 8B decides write start address information for the second block that reflects the registration adjustment width amount for the data of the first block. The same applies for the data of the other colors (data of the second color to data of the eighth color).

Before completing the writing of recording data corresponding to the first block data, the writing control section 8B can update the write address information for the registration width amount of the first block data to the write start address that was decided.

Reference numeral 816 denotes a register that stores a write address (WP) of data.

Reference numeral 814 denotes an address control register that manages read processing and write processing so as to prevent the write address (WP) from exceeding the read address (RP) (prevent the two addresses from designating the same address).

Figure 5B:
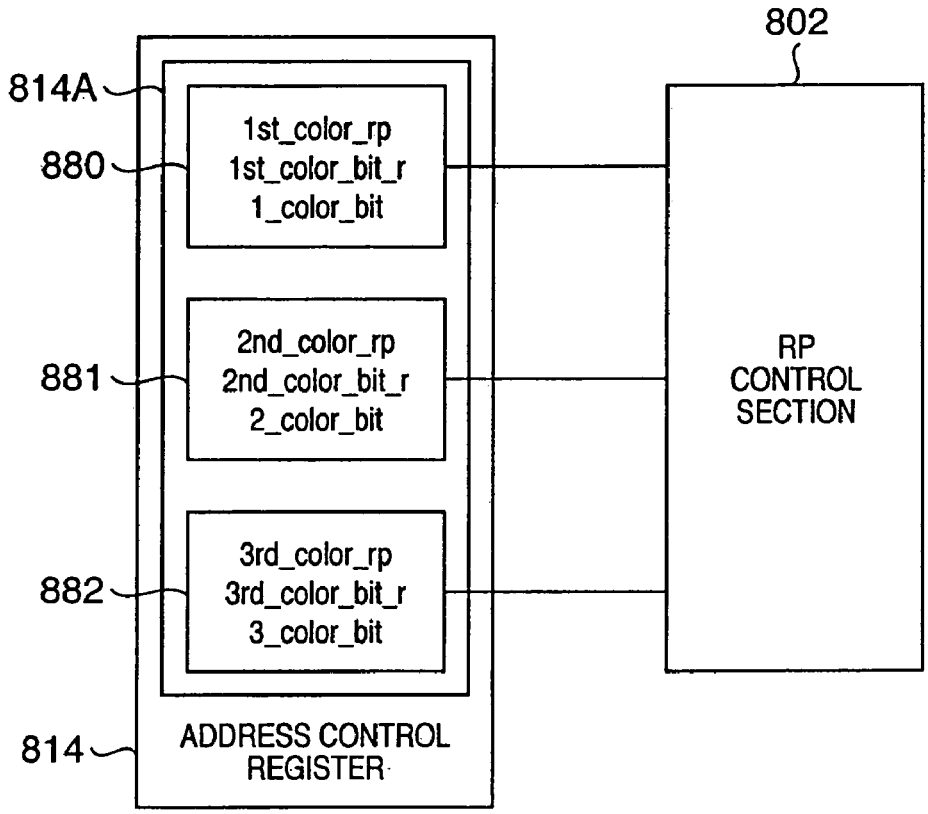
FIG. 5B is a view for explaining in detail an address control register of FIG. 5A.

The configuration of the address control register 814 will be described referring to FIG. 5B. The address control register 814 has a selection section 814A which selects a data write destination. The selection section 814A has a register which holds read pointer information and information indicating the existence or non-existence of data corresponding to a color. This register is provided for each nozzle array (for each color). To facilitate description, FIG. 5B illustrates an example in which the recording head comprises three nozzle arrays. FIG. 5B is a view for explaining a case in which the selection section 814A has three registers, i.e. a register for each of the three colors. Reference numeral 880 denotes a register which holds data corresponding to the first color, reference numeral 881 denotes a register which holds data corresponding to the second color, and reference numeral 882 denotes a register which holds data corresponding to the third color. The register 880 stores a read address of the first color (1st_color_rp), information indicating the existence or non-existence of read data of the first color (1_color_bit), and information indicating the existence or non-existence of write data of the first color (1_color_bit_w). The same applies for registers 881 and 882. Thus, the number of registers provided corresponds to the number of nozzle arrays. Accordingly, in a recording apparatus using a recording head comprising eight nozzle arrays, the selection section 814A comprises eight registers.

The selection section 814A selects which of the data corresponding to a color to store from among the data for the first color, data for the second color, and data for the third color. For example, although the data for the first to third colors are stored sequentially for a single block, when storing the data the selection section 814A refers to the information indicating the existence or non-existence of write data and information indicating the existence or non-existence of read data to determine whether or not to write data (although in this example the determination is made using both information indicating the existence or non-existence of write data and information indicating the existence or non-existence of read data, for example, the determination may be made using either one of these information).

If the register holds information which shows that both information indicating the existence or non-existence of write data and information indicating the existence or non-existence of read data exist, the data corresponding to that register is written to the recording buffer. In contrast, if the register holds information which shows that both the information indicating the existence or non-existence of write data and the information indicating the existence or non-existence of read data do not exist, the data corresponding to that register is not written.

When performing a write operation, data is written by referring to each register (for example, for the first color, the read address (1st_color_rp)).

<Control of Read Address and Write Address>

Hereunder, the conventional control methods and the control methods according to this embodiment are compared in relation to read address and write address control.

Figure 5C:
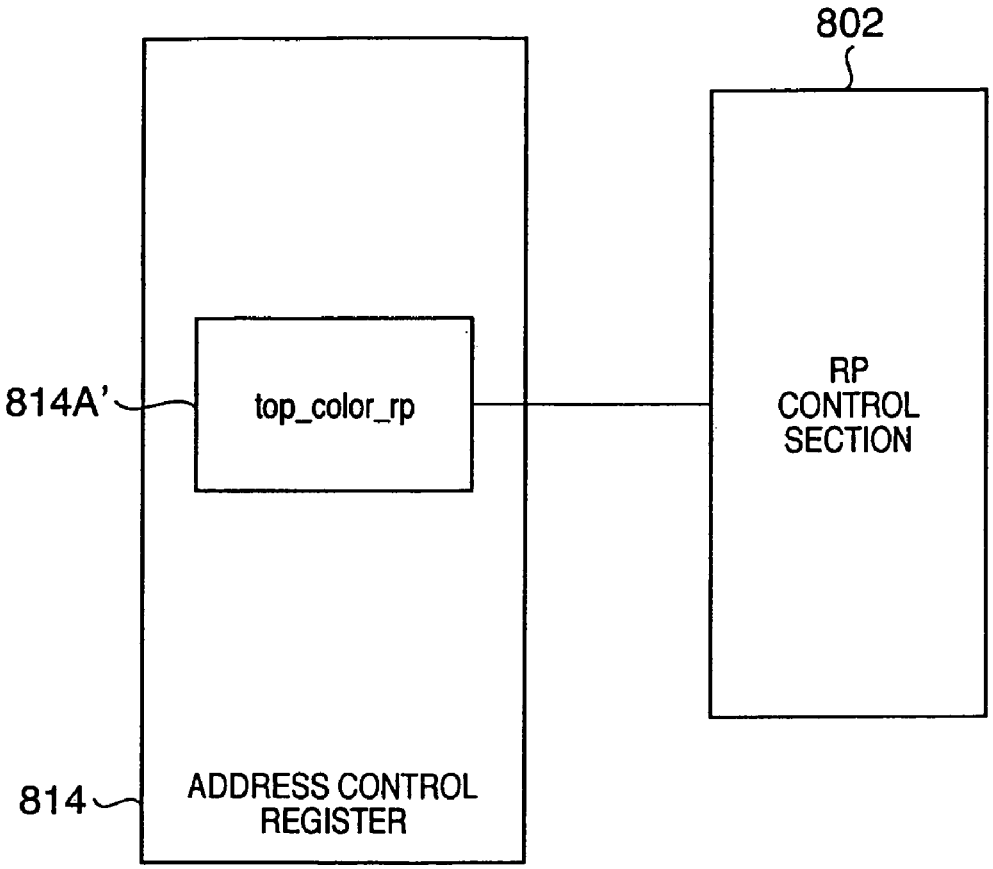
FIG. 5C is a view illustrating a conventional control method for reading/writing data from or to a recording buffer.
Figure 7A:
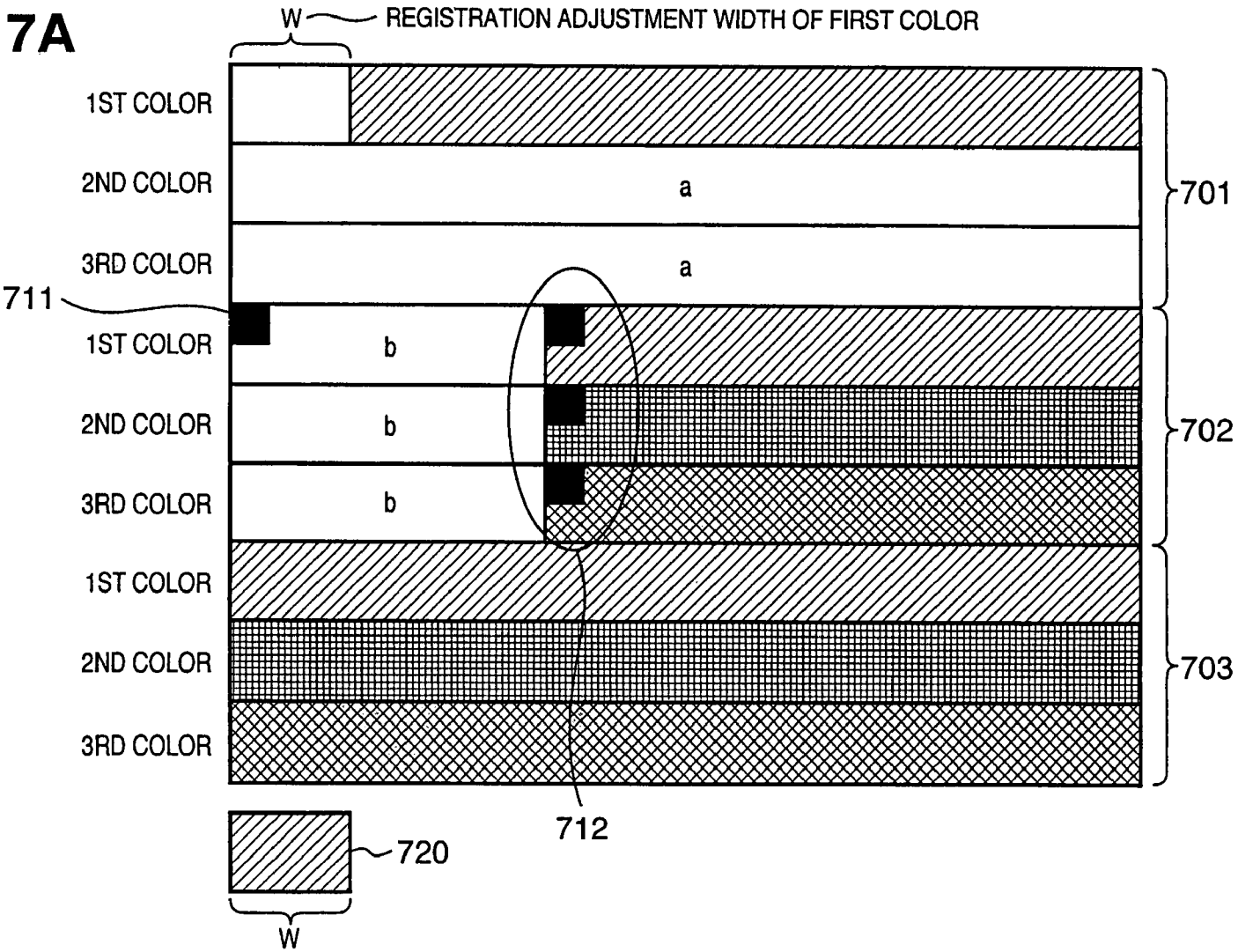
FIG. 7A is a view for explaining a conventional read address control method.

FIG. 7A and FIG. 5C are views for explaining a conventional control method to read/write data from or to a recording buffer. In FIG. 7A, reference numeral 701 denotes a block that is currently being written, reference numeral 702 denotes a block that is currently being read, and reference numeral 703 denotes a block to be read next. The areas denoted by reference numeral "a" are areas in which data of the respective colors are to be written later. The areas denoted by reference numeral "b" are areas from which data for colors was already read out. FIG. 5C shows the address control register 814 provided in the conventional write control section. The address control register 814 comprises a register 814A' that holds addresses that can be referred to from an RP control section 802. Accordingly, as shown in FIG. 5C, in the conventional write address control section 8B, one address could be referenced from the RP control section 802. This address was the top address of the block.

For example, when one block was constituted by data for a first color and data for a second color, the top address of a region holding data for the first color was referenced as the top address of the block. When another block was constituted by data for a third color, data for a fourth color and data for a fifth color, the top address of a region holding data for the third color was referenced as the top address of the block.

Accordingly, in the conventional control method, after reading out of all the data of the block 702 that is currently being read finishes, an address 711 stored in the register 814A' was updated to a top address 713 of the block 703 to be read out next (711 and 713 are read pointers that the write address control section can reference). That is, the unit for updating addresses of the address control register 814A' provided in the conventional write control section was one block. Therefore, until the data for all the colors in one block has been read out, data cannot be written to the area denoted by reference numeral "b" from which data was actually already read out or to an area in which data for a color does not exist. Thus, although the conventional method has an advantage that management of read addresses is simple, the method cannot use memory areas effectively.

As a specific example, as shown in FIG. 7A, even in a state in which a data 720 that protrudes by a registration adjustment width W of the first color can be stored in the area denoted by reference numeral "b" (capacity of b>capacity of 720), it is not possible to write even a single piece of the protruding data 720 (if one word is the write unit, not even one word can be written). Therefore, in a low cost recording apparatus in which the capacity of the recording buffer is reduced, for the data of each color that protrudes due to registration adjustment, the write wait frequency increases and the write wait time also becomes longer.

Figure 7B:
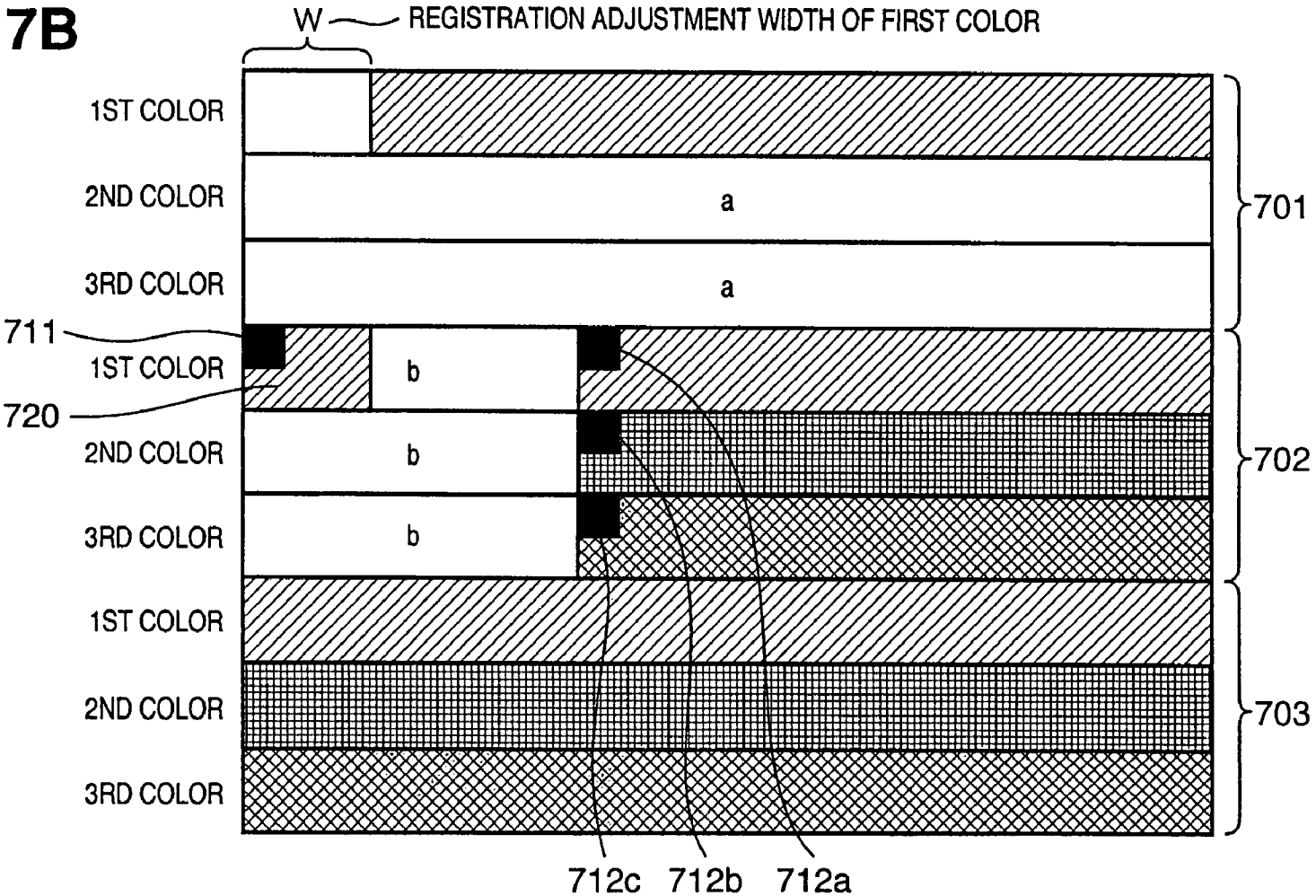
FIG. 7B is a view for explaining the read address control method according to this invention.

In contrast, FIG. 7B is a view illustrating a control method for reading/writing data from or to the recording buffer according to the present embodiment, in which like reference symbols designate the same or similar parts as FIG. 7A. This read address control method updates the read pointer of each nozzle array (each color) every time data is read out. More specifically, read pointers 712*a*, 712*b*, and 712*c* are independently provided for the data for each color, and control is performed to update the values of the pointers designating the addresses together with an actual read operation. These addresses are respectively held in the address control register 814 that was described already in FIG. 5B. The address values of the address control register 814 are updated in units of one column for each color (nozzle array). Thus, since the unit for updating information for a read pointer that is sent to the write address control section is changed from a single block to a single column, the data storage efficiency is improved.

As a specific example, according to the control method of this invention, when data has been read out the address of the read pointer can be updated to make an area (space) to perform writing. Accordingly, the write wait time becomes shorter than hitherto. Since the read pointer advances as data is read out accompanying the progress of the recording operation, it is possible to store the data 720 that protrudes due to registration adjustment of the first color in the area "b". Accordingly, the data 720 protruding due to registration adjustment of the first color can be written in area "b". In this connection, if the read pointer advances by even one address (for example, 16 bits) when data is read out, data for one address of the data 720 protruding due to registration adjustment can be stored. It is therefore possible to efficiently use the memory area even in a low cost recording apparatus in which the capacity of the recording buffer was reduced. Thus, for data that protrudes due to registration adjustment of each color, it is possible to decrease the write wait frequency and reduce the write wait time.

As the operations in this example, the output of read addresses (RP) is performed by the RP control section 802 based on the settings of the registers 880 to 887 for each color. More specifically, the read address corresponding to the color that is currently being written is output.

This will be described referring to FIG. 7B. It is assumed that at this time writing of most of the data for the first color is finished and only the data 720 protruding due to registration adjustment for the first color is in a write wait state.

Here, we will assume a case where a decision as to whether or not the data 720 protruding due to registration adjustment of the first color can be written is made by referring to a read address other then a read address of the first color, i.e. a read address of another color.

The read addresses of the first color to third color are controlled independently for each color. Therefore, it will be understood that even if an address of the second color or third color were used to decide whether or not the data 720 protruding due to registration adjustment of the first color can be written, a correct decision cannot be made. This also applies to writing of the second color and third color. It will also be understood that even if a read address of a color other than the color that is currently being written is used to decide whether or not "data protruding due to registration adjustment of the nth color" can be written, a correct decision cannot be made.

For the above reasons, in this embodiment a decision as to whether or not data protruding due to registration adjustment of each color can be written is made by referring to the corresponding read address.

As a premise for performing this kind of control, it is necessary that the number of colors, data buffer height and width of blocks used which are used for recording are not modified during the same scan.

<Data Storage in Recording Buffer (FIGS. 6A-6D)>

Figure 6A:
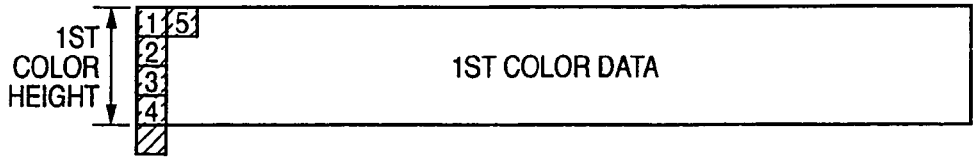
FIGS. 6A to 6D are views for explaining the manner in which recording data is stored in the recording buffer.

FIGS. 6A-6D are views that illustrate the manner in which recording data is stored in the recording buffer 4. FIG. 6A illustrates a state in which data as the data of the first color is stored vertically in sequence in amounts of four words. In this example, one word corresponds to 16 pixels. Assuming that addresses for storing information in a register are incremented one at a time, the write pointer (WP) is counted in the manner 1→2→3→4→5→ . . . .

For example, in the settings for the register of FIG. 6A, the value (1st_height) for buffer height information (the number of rasters) is "4", and the value for information indicating the existence or non-existence of data is "1 (exists)". The value of the register 813 (block width information: block_width) is "28".

Figure 6B:
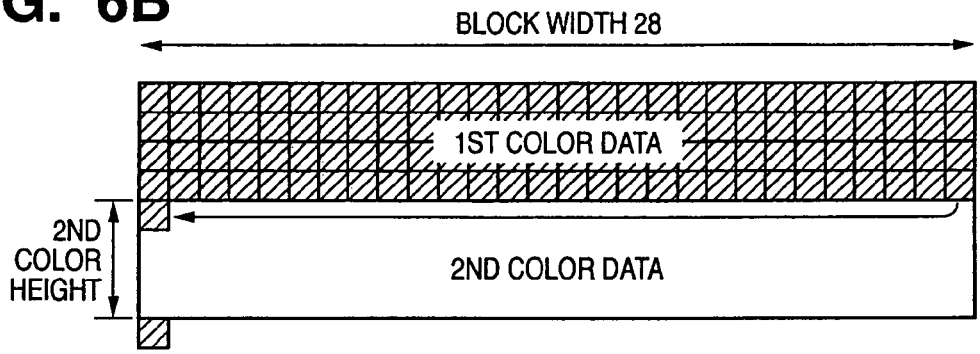
Figure 6C:
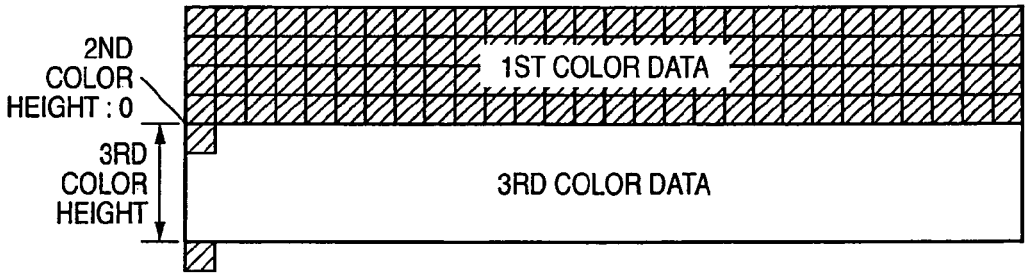

FIG. 6B illustrates writing of data to the recording buffer 4 when data exists for a second color. After storing all the data in the storage area for the first color, the write pointer (WP) moves to the top address of the second color as shown by the arrow, and storing of the second color data is performed. FIG. 6C shows a case in which, when there is no data for a second color, data of a third color is stored following the storage area for the data of the first color. In this case, the value of information indicating the existence or non-existence of data of a second color (2_color_bit) of the register 806 shown in FIG. 5 is "0 (none)", indicating that no data exists. Alternatively, if the buffer height information (2nd_height) is "0", this information may also be used since it indicates that no data exists. Alternatively, an AND operation may be performed for the information indicating the existence or non-existence of data and the buffer height information, and a decision may be made using that result.

Figure 6D:
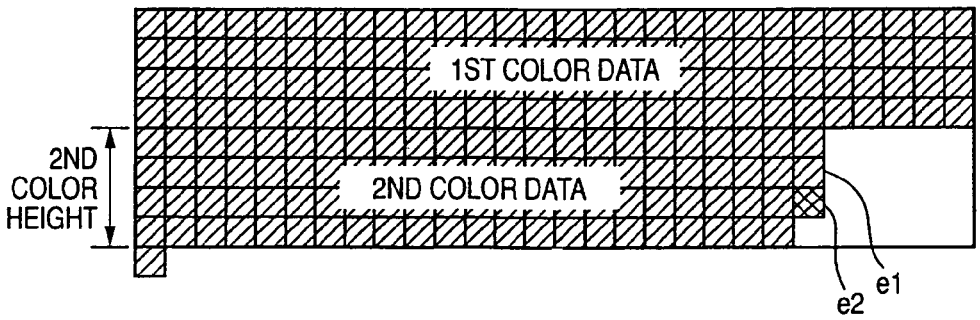

FIG. 6D illustrates, for data of the second color, that writing of a write position denoted by reference numeral e1 (WP: write pointer) stops before a read position denoted by reference numeral e2 (RP: read pointer). This control is performed to prevent overwriting by prohibiting writing of data at a position at which reading is not completed. The above control similarly applies to areas of the third color to eighth color.

<Reading Data from Recording Buffer>

Hereunder, processing to read data from a recording buffer will be described referring to FIG. 8. In FIG. 8, the left side illustrates the read address control section 8A of the record buffering structure control circuit 8, and the right side illustrates the recording buffer 4.

The buffer area of the recording buffer 4 is defined by the top address as represented by top_adr and the bottom address as represented by bottom_adr of the recording buffer. The top address is stored in the register 803, and the bottom address is stored in the register 804. Similarly to FIG. 5A, reference characters "RP" at the recording buffer denote a read pointer, and reference characters "WP" denote a write pointer. The hatched portion between reference characters RP and WP in the recording buffer 4 means that recording data is stored therein, and the remaining portion means that no recording data is stored.

Reference numeral 802 within the read address control section 8A denotes an RP control section that shows a data read address (RP: Read Pointer) for each color as described above. A block 900 surrounded by a broken frame represents the first register group, and a block 901 surrounded by a solid frame represents the second register group.

When recording the recording data of the first block to eighth block, for example, at the start of scanning, information for the first block is stored in the first register group. In the second register group, information for the second block is stored. When recording of the first block ends, the information of the second register group 901 is copied and stored in the first register group 900. Information for the third block is then stored in the second register group 901. Thereafter, the same processing is performed in sequence until the data of the final eighth block is stored. At the start of the next scanning, information for the first block is again stored in the first register group and information for the second block is stored in the second register group.

When information of the (n+1)th block is not stored in the second register group when recording of the nth block shown by the first register group ends, it indicates that the recording data of the (n+1)th block has not yet been prepared. Accordingly, information of the second register group is not copied to the first register group and reading of data from the recording buffer stops.

The register 819 that is inside the first register group is a register for setting height information for the first color (1st_height) and information indicating the existence or non-existence of color data (1_color_bit). The registers 822, 824, 826, 828, 830, 832, and 834 are registers that respectively set height information and information indicating the existence or non-existence of data in a similar manner for the second to eighth colors.

Reference numeral 820 denotes a register that stores width information (block_width) for each block data. This width information is a value that is commonly used for each block from the first to eighth colors.

A register 818 stores the read address (1st_color_adr) of the first color. The address is updated upon read from a recording buffer 819 which stores the recording data for the first color.

The read address (1st_color adr) of the first color corresponds to 1st_color_rp of the register 880 of the selection section 814A described in the explanation for FIG. 5B, or 712*a* described in the explanation for FIG. 7B. Likewise, the read address (2nd_color_adr) of the second color corresponds to 2nd_color_rp of the register 881 of the selection section 814A described in the explanation for FIG. 5B, or 712*b* described in the explanation for FIG. 7B. The same applies for the read addresses of the other colors.

To read out this data, for example as shown in FIG. 6A, recording data of one column in the first color area is read out in the manner 1→2→3→4. Registers 821, 823, 825, 827, 829, 831, and 833 store the read addresses of the second to eighth colors, respectively. The recording data for the second to eighth colors are also sequentially read out by reading the data of one column in the same manner as that of the first color.

Because the data stored in the recording buffer 4 includes data for a plurality of colors, for example, in a case where the data of the first color, second color . . . was mixed, the addresses for storing data of each color unit are not consecutive. Therefore, if there is one register of read addresses, for example, when reading the address in recording buffer 4 of the first color and then the address in recording buffer 1 of the second color, it is necessary to perform an address calculation. However, by providing a register that stores the read addresses for each color in the recording buffer 4, it is possible to omit the address calculation when performing reading in column units.

Reference numeral 817 denotes an address control register. When the record data generating block 5 requests read addresses for each color through the data read request signal line S805, the address control register 817 adds one address at a time as a read address and outputs the address to the recording buffer 4 through the signal line S806.

Reference numeral 835 denotes a register that stores an address of the next block. If the block that is being currently read is the first block, the top address of the second block is stored in this register. When reading of the block data that is currently being read ends, the value of this register is copied to the register 802. Thus, reading of the next block data can be performed smoothly.

A register 836 is a table that stores information for specifying the reading order with respect to the first to eighth colors. The sequence of reading data from the recording buffer can be freely set using the value set in this table. For example, data can be read in the order of first color→second color→ . . . →eighth color. Alternatively, by changing the value, reading of the data of the third color and fourth color can be skipped so as to read data in the order of first color→second color→fifth color→sixth color→seventh color→eighth color. Thus, it is possible to accurately skip reading of recording data for a color that is not stored.

The second register group 901 is a group of buffers that store information relating to the next block data. When each register of the first register group has been read, the values set in each register of the second register group are set in the corresponding registers of the first register group. For example, the value set in register 838 is set in register 819. Registers 839 to 845 are registers in which similar information is set for the data of the second color to eighth color in the next block data.

In the register 838 (819), buffer height information for data of the first color and information indicating the existence or non-existence of data of the first color is stored.

Reference numeral 846 (820) denotes a register for setting block width information. This width information is a value that is commonly used for each block from the first to eighth colors.

A register 878 is a register that stores information (same_type) indicating whether or not the size of the block in question is the same as the size of the preceding block that was set. By setting this value to "1" when the block size is the same, the same values can be easily reset in the first register group. In that case, setting of registers 838 to 846 can be omitted. In contrast, when the value of the register 878 is "0", the respective values are set in the registers 838 to 846.

As described above, according to the preferred embodiment, registers which store read addresses of recording data are provided in correspondence to respective recording element arrays in an inkjet recording apparatus, and the inkjet recording apparatus is given a function of updating the corresponding read address each time recording data is read out. As a result, transfer of recording data from a host computer can be speeded up, and a time until the recording apparatus executes recording upon designation of recording by the host computer can be shortened.

<Calculation of Registration Adjustment Value>

The registration adjustment value information (1_reg_wnum) between nozzle arrays that was described for this embodiment will differ for individual recording heads (recording cartridges) and their installation. Therefore, although the values may be set during an inspection step or the like before shipment, preferably a value is set that was input by the user after visually identifying or reading with a scanner or the like the amount of deviation in a predetermined test pattern that was recorded after exchanging the recording head (recording cartridge). For example, a settings menu may be provided in a printer driver operating on the host computer to allow the user to set the registration adjustment value information using that menu.

As a further example, a user may use an operating panel provided on the recording apparatus to set the amount of deviation that the user visually identified. The registration adjustment value information entered by this setting is stored in storage means provided in the recording apparatus. The registration adjustment value information stored in the storage means can be used by the above described record buffering control circuit 8. A configuration may then be adopted whereby registration adjustment value information is transferred in advance from the recording apparatus to the host computer before transferring recording data from the host computer to the recording apparatus.

Detection or calculation of an adjustment value on the basis of this kind of recorded test pattern can be performed by various methods that are already known. However, a detailed description of such methods has been omitted herein, as they do not constitute a feature of this invention.

Other Embodiments

Although the above embodiment described an example in which this invention was applied to an inkjet recording apparatus that performs recording according to an inkjet printing system, this invention can also be applied to a recording apparatus according to a different system, as long as it is a recording apparatus that performs recording by scanning a recording head in which a plurality of recording elements are aligned, in a direction intersecting with the alignment direction of the recording elements.

The above embodiment can achieve high-density, high-definition recording by, in particular, using a system which, even among inkjet recording systems, comprises means (for example, an electrothermal converter or laser) for generating thermal energy as energy to be utilized for discharging ink, and causes a change in state of an ink as a result of the thermal energy.

In addition, not only a cartridge type recording head, as described in the above embodiment, in which an ink tank is integrally arranged on the recording head itself but also an exchangeable chip type recording head which can be electrically connected to the apparatus main body and can receive ink from the apparatus main body upon installation thereof on the apparatus main body can be applied to the present invention.

Further, in addition to the form of an incorporated device or an additional device as an image output terminal of an information processing device such as a computer, the recording apparatus according to the present invention can be in the form of a copying machine with a reader or a facsimile machine which has transmission/reception functions, or a multifunction device that combines the functions of a copying machine and a facsimile machine.

As many apparently widely different embodiments of the present invention can be made without departing from the spirit and scope thereof, it is to be understood that the invention is not limited to the specific embodiments thereof except as defined in the appended claims.

This application claims the benefit of Japanese Application No. 2005-064559, filed Mar. 8, 2005, which is hereby incorporated by reference herein in its entirety.

What is claimed is:

1. A recording apparatus that records by scanning a recording head having a plurality of recording element arrays, in which a plurality of recording elements are aligned, in a direction intersecting with the alignment direction, relative to a recording medium, said apparatus comprising:

a receiving buffer which stores setting data and recording data that are transmitted from a connected host device, the setting data containing registration information in a scanning direction corresponding to the recording element arrays, the recording data containing plural items of block data, each item of block data containing at least data for one recording element array;

a print buffer which has a plurality of memory areas includes at least a first memory area and a second memory area in correspondence with the scanning direction, the first memory area and the second memory area being assigned a predetermined number of columns, respectively;

a reading control unit which performs reading of the print buffer and performs updating of column position information for each of the recording element arrays; and a writing control unit which includes a plurality of registers, each holding the column position information, and performing storing of data of an upper side in the scanning direction of block data to the first memory area and storing of data of a lower side in the scanning direction of the block data to the second memory area, on the basis of the registration information corresponding to the recording element arrays and the column position information held in the plurality of registers.

2. The recording apparatus according to claim 1, wherein the writing control unit modifies storage starting positions in the memory area for each of the recording element arrays in accordance with the registration information.

3. The recording apparatus according to claim 1, wherein a capacity of the print buffer is less than a data amount that the recording head can record with one scanning.

4. The recording apparatus according to claim 1, wherein recording is performed by the recording element arrays in respectively different colors.

5. The recording apparatus according to claim 1, wherein recording is performed by discharging ink from the recording elements.

* * * * *